US006149535A

United States Patent [19]

Bissonnette et al.

[11] Patent Number: 6,149,535

[45] Date of Patent: Nov. 21, 2000

[54] GOLF BALL WITH SPUN ELASTIC THREADS

[75] Inventors: Laurent Bissonnette, Portsmouth, R.I.; Roman Halko, Natick; Manny Vieira, New Bedford, both of Mass.

[73] Assignee: Acushnet Company, Fairhaven, Mass.

[21] Appl. No.: 09/266,847

[22] Filed: Mar. 12, 1999

[51] Int. Cl.[7] ..... A63B 37/08

[52] U.S. Cl. ..... 473/354; 57/210; 57/225; 428/74; 428/401; 473/354; 473/356; 473/357; 473/360; 473/362

[58] Field of Search ..... 473/356, 357, 473/360, 362; 428/74, 401; 57/210, 225

[56] References Cited

U.S. PATENT DOCUMENTS

| | | | |
|---|---|---|---|
| 587,764 | 8/1897 | Short | 57/210 |
| 3,097,192 | 7/1963 | Schilit | 57/225 |
| 3,405,516 | 10/1968 | Laurenti | 57/204 |
| 3,616,101 | 10/1971 | Satchell et al. | 161/7 |
| 4,228,641 | 10/1980 | O'Neil | 57/234 |
| 4,469,739 | 9/1984 | Gretzinger et al. | 428/198 |
| 4,473,229 | 9/1984 | Kloppenburg et al. | 273/225 |
| 4,763,466 | 8/1988 | Abe et al. | 57/213 |
| 4,783,078 | 11/1988 | Brown et al. | 273/216 |
| 5,597,649 | 1/1997 | Sandor et al. | 428/370 |
| 5,679,196 | 10/1997 | Wilhelm et al. | 156/167 |
| 5,683,312 | 11/1997 | Boehm et al. | 473/354 |
| 5,685,785 | 11/1997 | Kakiuchi et al. | 473/354 |
| 5,713,801 | 2/1998 | Aoyama | 473/354 |
| 5,816,939 | 10/1998 | Hamada et al. | 473/357 |
| 5,827,167 | 10/1998 | Dougan et al. | 473/356 |
| 5,962,140 | 10/1999 | Rajagopalan | 428/421 |

*Primary Examiner*—Stephen F. Gerrity
*Assistant Examiner*—Paul D. Kim
*Attorney, Agent, or Firm*—Pennie & Edmonds LLP

[57] ABSTRACT

The present invention is directed towards a golf ball which comprises a center, at least one cover layer, and at least one layer of windings between the center and the cover. Preferably, the thread of the present invention is comprises of at least about 10 individual strands that are each about 0.01 inches in diameter. Most preferably, the thread is a solvent spun polyether urea thread manufactured by combining over 25 strands with diameters of less than about 0.002 inches. Because of the smaller thread dimension, the thread of the present invention is capable of being wound more densely than the typical thread. The elastic modulus of this thread is greater than about 20 ksi when wound about a center. The maximum elongation of the thread is greater than about 8%. The smaller cross-sectional area of the thread and higher elastic modulus of the thread also enable production of golf balls with less total thread volume. Thus, wound balls with larger liquid or solid centers may be produced to achieve desired spin characteristics.

27 Claims, 4 Drawing Sheets

GOLF BALL WITH SPUN ELASTIC THREADS

BACKGROUND OF THE INVENTION

Conventional golf balls can be divided into two general types of groups: solid balls or wound balls (also known as three piece balls). The difference in play characteristics resulting from these different types of construction can be quite significant. Balls having a solid construction are generally most popular with the average recreational golfer because they provide a very durable ball while also providing maximum distance. Solid balls are generally made with a single solid core usually made of a cross linked rubber, which is enclosed by a cover material. Typically the solid core is made of polybutadiene which is chemically crosslinked with zinc diacrylate and/or similar crosslinking agents and is covered by a tough, cut-proof blended cover. The cover is generally a material such as SURLYN®, which is a trademark for an ionomer resin produced by DuPont. The combination of the core and cover materials provide a "hard" ball that is virtually indestructible by golfers. Further, such a combination imparts a high initial velocity to the ball which results in increased distance. Because these materials are very rigid, solid balls can have a hard "feel" when struck with a club. Likewise, due to their construction, these balls have a relatively low spin rate which provides greater distance.

At the present time, the wound ball remains the preferred ball of the more advanced player due to its spin and feel characteristics. Wound balls typically have either a spherical solid rubber or liquid center core around which many yards of a stretched elastic thread are wound. The wound core is then covered with a durable cover material such as a SURLYN® or similar material or a softer cover such as Balata or polyurethane. Wound balls are generally softer and provide more spin, which enables a skilled golfer to have more control over the ball's flight and position. Particularly, with approach shots onto the green, the high spin rate of soft, wound balls enable the golfer to stop the ball very near its landing position.

Regardless of the form of the ball, players generally seek a golf ball that maximizes total game performance for their requirements. Therefore, in an effort to meet the demands of the marketplace, manufacturers strive to produce golf balls with a wide variety of performance characteristics to meet the players individual requirements. Thus, golf ball manufacturers are continually searching for new ways in which to provide golf balls that deliver the maximum performance for golfers of all skill levels.

To meet the needs of golfers with various levels of skill, golf ball manufacturers are also concerned with varying the level of the compression of the ball, which is a relative measurement of the golf ball stiffness under a fixed load. A ball with a high compression feels harder than a ball of lower compression. Wound golf balls generally have a lower compression which is preferred by better players. Whether wound or solid, golf balls typically become more resilient (i.e., have higher initial velocities) as compression increases. Manufacturers of both wound and solid construction golf balls must balance the requirement of higher initial velocity from higher compression with the desire for a softer feel from lower compression.

To make wound golf balls, manufacturers use winding machines to stretch the threads to various degrees of elongation during the winding process without subjecting the threads to unnecessary incidents of breakage. Generally, as the elongation and the winding tension increases, the compression and initial velocity of the ball increases. Thus, a more resilient wound ball is produced, which is desirable.

Referring to FIG. 1, a conventional golf ball thread 10 is shown. In general, a single-ply golf ball thread or two-ply thread 10 is formed and wound around a center. Single-ply threads are generally made using a liquid latex that is cast into a sheet and then slit into threads having a generally rectangular or square cross-section. Two-ply threads are generally made by mixing synthetic cis-polyisoprene rubbers, natural rubber and a curing system together, calendering this mixture into two sheets, calendering the sheets together, curing the sheets to vulcanize and bond the sheets together, and slitting the resultant sheet into threads having a generally rectangular or square cross-section. Another method of forming threads is an extrusion method. However, extruded thread has not been used in golf ball applications. An example of an extruded thread that is not used in golf balls is disclosed in U.S. Pat. No. 5,679,196 issued to Wilhelm et al. This patent discloses a thread formed of a mixture that has more than 50% natural rubber.

A number of different windings have been disclosed for use in golf balls. U.S. Pat. No. 4,473,229 to Kloppenburg et al discloses a golf ball having a core formed of graphite fibers and windings made of graphite filaments and resins. Yarns are made with the graphite filaments and resins, and as many as four or more yarns are combined to form a final yarn used for winding. U.S. Pat. No. 5,713,801 to Aoyama discloses use of a layer of high tensile elastic modulus fibers wound about the core. The fibers have a tensile elastic modulus of at least 10,000 ksi. Also, U.S. Pat. No. 5,816,939 to Hamada et al. discloses a rubber thread for winding with a tensile strength retention of $\geqq 70\%$, a hysteresis loss of $\leqq 50\%$, and an elongation of 900–1400%.

Prior art wound golf balls and cores typically use polyisoprene rubber thread. The polyisoprene thread is wound onto the cores at elongations between 500–1000%. The amount of thread required for a golf ball core is dependent on the elastic modulus of the thread in the elongated state. Elongated polyisoprene thread has an elastic modulus between 10 and20 ksi. Further, the properties, in particular resilience, of the wound ball or core are dependent on how well the thread packs during winding. The dimensions of the thread control the packing density. Present art polyisoprene threads are typically 1/16" wide by 0.02" thick, measured prior to winding. However, present are polyisoprene thread is commonly produced in thickness between 0.014" and 0.024".

There are some drawbacks to the conventional single-ply threads used in golf balls. The single-ply occasionally contains weak points. As a result, manufacturers of wound balls do not wind using the maximum tension or stretch the thread to the maximum elongation, because to do so would cause an excessive amount of breakage during winding. When a thread breaks during manufacturing, an operator must restart the operation. This decreases production, and is thus undesirable. The use of two-ply threads in golf balls reduces but does not eliminate this problem.

The thread can also break during play due to impact of a club with the ball. These breaks can result in various consequences. The cover material is disposed between the thread portions adjacent the cover. When the thread portions adjacent the cover break, the cover material tends to hold these thread portions in the proper position. However, if enough thread portions break near the cover, a lump will be created on the outside surface of the ball, which makes the ball unplayable.

More severe problems can occur, when the thread portions near the center break. In a wound ball with a solid rubber center, the resilient rubber of the center is relatively soft compared to the hardness of the highly stretched thread portions. After a thread portion adjacent the center breaks, the thread portion can contract and cause a loss of compression and resiliency. This results in a distance loss, which is undesirable.

In a wound ball with a fluid-filled center, after a thread portion adjacent the center breaks, the resultant imbalance in stress adjacent the center causes the thread to cut through the envelope that contains the fluid. This destroys the structural integrity of the ball and makes it unplayable. If this type of failure happens during a shot, it can result in a short shot. It can also result in the ball deviating from its line of flight as it leaves the club, so that the ball can end up off the fairway. Both of these consequences are undesirable.

Therefore, golf ball manufacturers are continually searching for new ways in which to provide wound golf balls that deliver the maximum performance for golfers while decreasing the occurrence of thread breaks both during manufacturing and during play. It would be advantageous to provide a wound golf ball with a lower compression, higher initial velocity, more dense packing, improved durability, and improved manufacturing processibility. The present invention provides such a wound golf ball.

SUMMARY OF THE INVENTION

The present invention is directed to wound single and multilayer golf ball cores and golf balls. Generally, the prior art has been directed to making golf balls and cores using single strand polyisoprene thread. The resilience and other properties of the golf ball are dependent on how well the thread packs during winding. The present invention is directed to a golf ball that has threads that pack densely during winding.

The present invention is directed to a new type of golf ball thread with a smaller thread cross-sectional area. Moreover, the thread is comprised of many strands and has a higher than typical modulus of elasticity. The higher modulus of elasticity allows less thread to be used during the winding process.

The present invention is also directed to a golf ball that includes a larger than conventional center over which the thread is wound. The smaller dimensional thread with a higher modulus of elasticity causes less air pockets during winding. The thread is more densely packed and has a higher elastic modulus than the typical polyisoprene thread, allowing the winding layer to require less of the ball's volume. Thus, the center can have an expanded portion of ball volume. This enables the golf ball designer to develop wound golf balls with larger centers and a thin wound elastic layer to produce unique playing characteristics.

The threads of the present invention preferably have a smaller cross-sectional area than the isoprene threads of the prior art, which results in greater packing density and superior properties. The threads of the present invention comprise about 10 or more individual fibers or strands. Preferably, the thread contains more than 50 fibers. The fibers are continuous filaments with diameters typically of less than 0.01 inches. Preferably, the fiber diameter is less than about 0.002 inches. Because the thread is comprised of many individual strands, the incidence of breakage of one strand has less effect than a breakage occurring with a single strand polyisoprene winding. If one strand of the invention thread breaks, the remaining strands will hold the winding secure. Thus, less dramatic results will occur of a single or a few strands break in the thread of the present invention in comparison to a breakage in prior art polyisoprene thread.

The golf ball of the present invention also provides a wound core of a golf ball with unique construction and performance characteristics through the use of spun elastic thread for the wound layer. Melt spinning, wet spinning, dry spinning, and polymerization spinning may be used to produce filaments which are combined to form the threads.

The thread preferably sustains at least about 8% elongation prior to failure. Preferably, the elastic modulus of the thread measured at an elongation equivalent to the elongation of the thread in a wound core is greater than about 20,000 psi.

The thread is preferably comprised of a polymeric material. Suitable polymers include polyether urea, such as LYCRA, polyester urea, polyester block copolymers such as HYTREL, isotactic-poly(propylene), polyethylene, polyamide, poly(oxymethylene), polyketon, poly(ethylene terephthalate) such as DACRON, poly(p-phenylene terephthalamide) such as KEVLAR, poly(acrylonitrile) such as ORLON, trans, trans-diaminodicyclohexylmethane and dodecanedicarboxylic acid such as QUINA. LYCRA, HYTREL, DACRON, KEVLAR, ORLON, and QUINA are available from E.I. DuPont de Nemours & Co. Glass fiber and, for example, S-GLASS from Corning Corporation can be used.

The inner sphere, or center, of the golf ball may be of any dimension or composition, such as thermoset solid rubber sphere, a thermoplastic solid sphere, wood, cork, metal, or any material known to one skilled in the art of golf ball manufacture. Preferably, the solid inner sphere is comprised of a resilient polymer such as polybutadiene, natural rubber, polyisoprene, styrene-butadiene, or ethylene-propylene-diene rubber. Similarly, the inner sphere could be a liquid filled sphere or shell such as a rubber sack, a thermoplastic, or metallic shell design, in which the liquid could be of any composition or viscosity. It is also feasible to construct such a center with a void or gas center. In another embodiment, the center can be filled with a liquid, a gel, a paste, a cellular foam, or a gas.

Preferably, the center outer diameter is larger than the typical center. More preferably, the center is at least about 1.1 inches. Most preferably, the center outer diameter is about 1.2 to 1.5 inches. Preferably, the combination of the center and the wound layer has an outer diameter of about 1.4 to 1.62 inches.

Finally, a cover is molded around the core. Any process that results in accurate and repeatable central placement of the core within the cover is acceptable. Generally, covers are applied by compression molding, injection molding or casting cover material over the core.

BRIEF DESCRIPTION OF THE DRAWINGS

FIG. 2 is not properly scaled in comparison to FIG. 1;

DESCRIPTION OF THE PREFERRED EMBODIMENT

Figure 1:
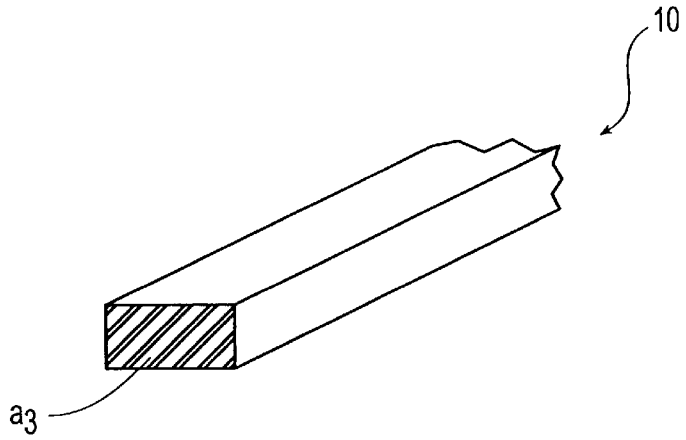
FIG. 1 PRIOR ART
FIG. 1 is an enlarged, partial perspective view of a conventional single-ply thread for use in a golf ball.

The present invention is directed to a wound single and multi-layer golf ball that uses a different material for winding that allows a lesser volume of thread to be used during winding of the center. Referring to FIG. 2–5, this invention is directed to a golf ball 50 which comprises at least a center 60, a wound layer 70 of thread 30, and a cover 80. The wound thread 30 is preferably of a construction shown in FIG. 2. The thread 30 is comprised of many individual filaments or strands 40. Preferably over 10 strands 40 make up the thread 30, and more preferably over 50 strands 40 form the thread 30. Most preferably, the thread contains greater than 100 strands. The strands 40 have a small diameter, typically of a diameter of less than 0.01 inches, and more preferably less than about 0.002 inches. Because the individual strands 40 have a small area $a_1$, the cross-sectional area $a_2$ of the thread 30 is still smaller than the typical thread area $a_3$ used to form a wound layer of a golf ball as shown by the prior art, which is generally about 0.0013 inches squared. Preferably, the strands 40 of the present invention have a cross-sectional area $a_1$ of less than 0.0001 inches squared and most preferably less than about 0.00001 inches squared. Preferably, the thread 30 of the present invention has a cross-sectional area $a_2$ of less than 0.001 inches squared and most preferably less than 0.005 inches squared.

Preferably, the thread 30 has an elongation to break of greater than about 8%. More preferably, the thread has an elongation to break of greater than 25%. A minimum of about 8% thread elongation prior to breakage allows the golf ball to deform during impact. A golf ball where the thread deforms significantly less than 8% during a typical driver impact will feel hard when struck and will have undesirable spin and feel characteristics. Preferably, the elastic modulus of the thread 30 in the wound state is greater than about 20,000 psi. More preferably, the elastic modulus is greater than 30,000 psi.

Figure 2:
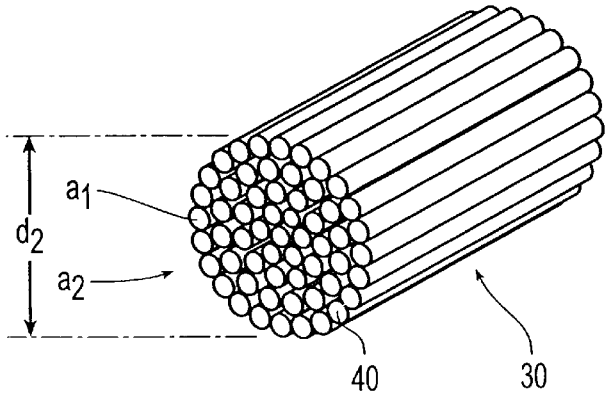
FIG. 2 is an enlarged, partial perspective view of a thread for use in a golf ball according to the present invention.

The strands of the thread may be held together with a binder as shown in FIG. 2 or they may be spun together. Melt spinning, wet spinning, dry spinning, and polymerization spinning may be used to produce threads.

Melt spinning is a highly economic process. Polymers are extruded through spinnerets by a heated spin pump. The resulting fibers are drawn off at rates up to 1200 m/min. The fibers are drawn and allowed to solidify and cool in the art. Because of the high temperatures required, only melting and thermally stable polymers can be melt spun. These polymers include poly(olefins), aliphatic polyamides, and aromatic polyesters. Hans-Georg Elias, *Macromolecules Synthesis, Materials, and Technology* 1246–47 (2nd ed. 1984).

For polymers that decompose on melting, the wet spinning method is used. Solutions of 5–20% are passed through the spinnerets by a spin pump. A precipitation bath is used to coagulate the filaments and a drawing or stretching bath is used to draw the filaments. Filament production rates under this method are lower than melt spinning, typically about 50–100 m/min. Because of solvent recovery costs, this method is less economical. Id.

In dry spinning, air is the coagulating bath. The method is usable for polymers that decompose on melting, however only when readily volatile solvents are known for the polymers. Solutions of 20–55% are used. After leaving spinneret orifices, resulting filaments enter a 5–8-m-long chamber. In the chamber, jets of warm air are directed toward the filaments. This causes the solvent to evaporate and the filaments to solidify. The process has higher rates of spinning than the wet spinning process. Typically, filament production rates are 300–500 m/min. The initial capital investment of equipment is higher, but the operation costs are lower than in wet spinning. Further, this process is only usable for spinning polymers for which readily volatile solvents are known. Id.

In another method of spinning, polymerization spinning, a monomer is polymerized together with initiators, fillers, pigments, and flame retardants, or other selected additives. The polymerizate is directly spun at rates of about 400 m/min. The polymerizate is not isolated. Only rapidly polymerizing monomers are suitable for this method. For example, LYCRA is produced by polymerization spinning. Id.

The thread is preferably comprised of a polymeric material. Suitable polymers include polyether urea, such as LYCRA, polyester urea, polyester block copolymers such as HYTREL, isotactic-poly(propylene), polyethylene, polyamide, poly(oxymethylene), polyketon, poly(ethylene terephthalate) such as DACRON, poly(p-phenylene terephthalamide) such as KEVLAR, poly(acrylonitrile) such as ORLON, trans, trans-diaminodicyclohexylmethane and dodecanedicarboxylic acid such as QUINA. LYCRA, HYTREL, DACRON, KEVLAR, ORLON, and QUINA are available from E.I. DuPont de Nemours & Co. Glass fiber and, for example S-GLASS from Corning Corporation can also be used.

Alternatively, threads made from natural fibers are contemplated for use in the present invention. More particularly, mineral fibers such as silicates, vegetable fibers such as cellulosic and animal fibers are contemplated. More particularly, the vegetable fibers can be broken into four groups: bast fibers, leaf fibers, seed-hair fibers and palm fibers. Bast fibers include those made from the bark or stems of certain plants, leaf fibers include those made from cordage, seed-hair fibers comprise cotton and kapok and palm fibers originate from other parts of plants. See, Hans-Georg Elias at 394.

The thread 30 may also be comprised of strands 40 having different physical properties to achieve desired stretch and elongation characteristics. For example, the thread 30 may be comprised of strands 40 of a first elastic type of material that is weak but resilient and also strands 40 of a second elastic type of material that is stronger but less resilient. In another example, the thread may be comprised of at least one strand of polyisoprene rubber thread having a diameter of less than 0.006 inches. This strand may be surrounded by about 10–50 polyether urea strands having diameters of less than 0.002 inches.

The manufacturing process for wound cores is such that the elastic fiber is extended during the winding process and then remains in the elongated state permanently. During use, when the club strikes the golf ball, a small perturbation or additional extension is applied to the wound thread as a result of ball deformation. Therefore, to properly characterize elastic fiber performance, one should make measurements that emulate use conditions. This is especially true for elastic fibers, as the stress strain relationship for these materials is highly nonlinear.

The elastic modulus is measured by clamping the elastic fibers in a test apparatus and elongating the fibers to an extension comparable to the extension associated with the core winding process. For example, in the case of polyisoprene thread, extensions between 500 and 1000% are typical. When spun LYCRA thread is used, winding elongations between 100 to 400% are typical. The gradient of the stress strain curve at the "winding" elongation is the elastic modulus. Referring to Graph 1, the elastic modulus at winding strain may be computed from the line drawn tangent to the stress strain curve at the winding strain. The elastic modulus is computed as the stress value of A minus B divided by the strain value of B minus C.

Graph 1
Typical Stress Strain Curve For Elastic Fibers

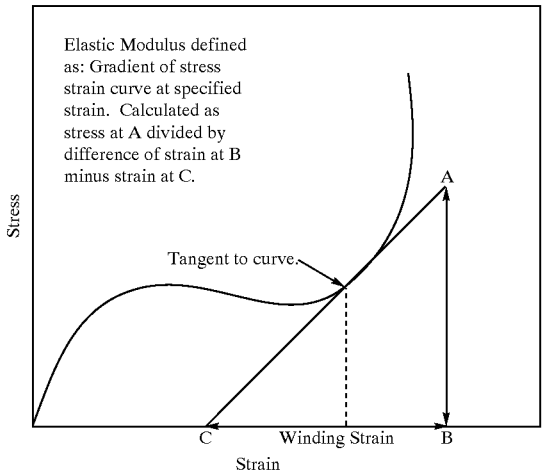

In one embodiment, the thread 30 is formed from solvent spun polyether urea elastomer LYCRA made by E.I. DuPont de Nemours & Company of Wilmington, Del. This thread 30 may be manufactured with a cross-sectional area much smaller than the isoprene threads typically used in forming the wound layer 70 of a golf ball. Because of the thread's 30 smaller diameter $d_2$, it may be used to form golf balls 50 and cores with greater packing density and superior properties. Also, the elastic modulus of the solvent spun polyether urea thread is greater than 30 ksi when elongated. Specifically, the elastic modulus is between 30 to 50 ksi when elongated between 200 and 400%. Elongation yielding optimal resilience of the thread is between 200 and 500%.

Because the threads 30 have a smaller cross-sectional area and a higher modulus of elasticity, the total volume $V_2$ of the thread 30 needed to form the wound layer 70 of a golf ball 50 is less. Because less volume is needed for the wound layer 70, the volume $V_1$ of the center 60 may be increased. Use of a larger solid center 60 or liquid center 60 can improve alterable characteristics. Such alterable characteristics include spin and compression.

Figure 4:
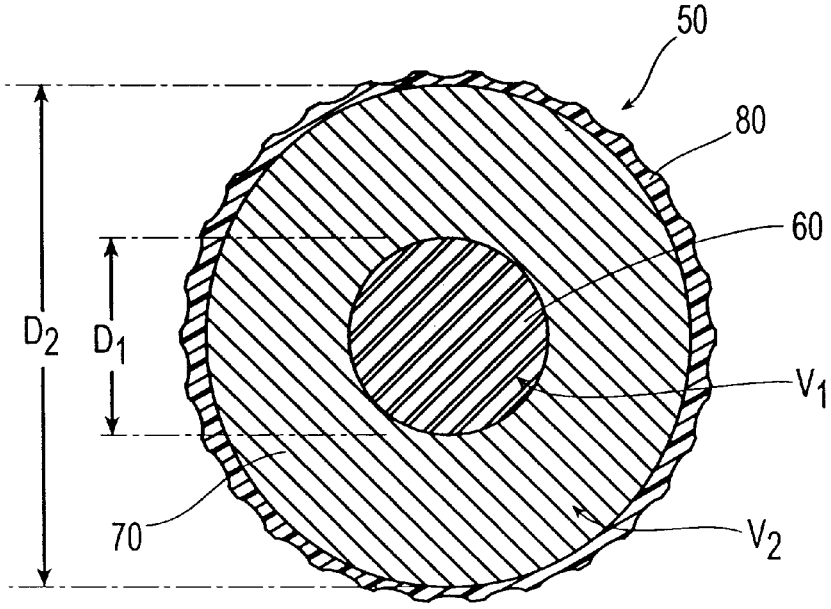
FIG. 4 is a cross-sectional view of the golf ball of FIG. 3 according to the present invention.
Figure 5:
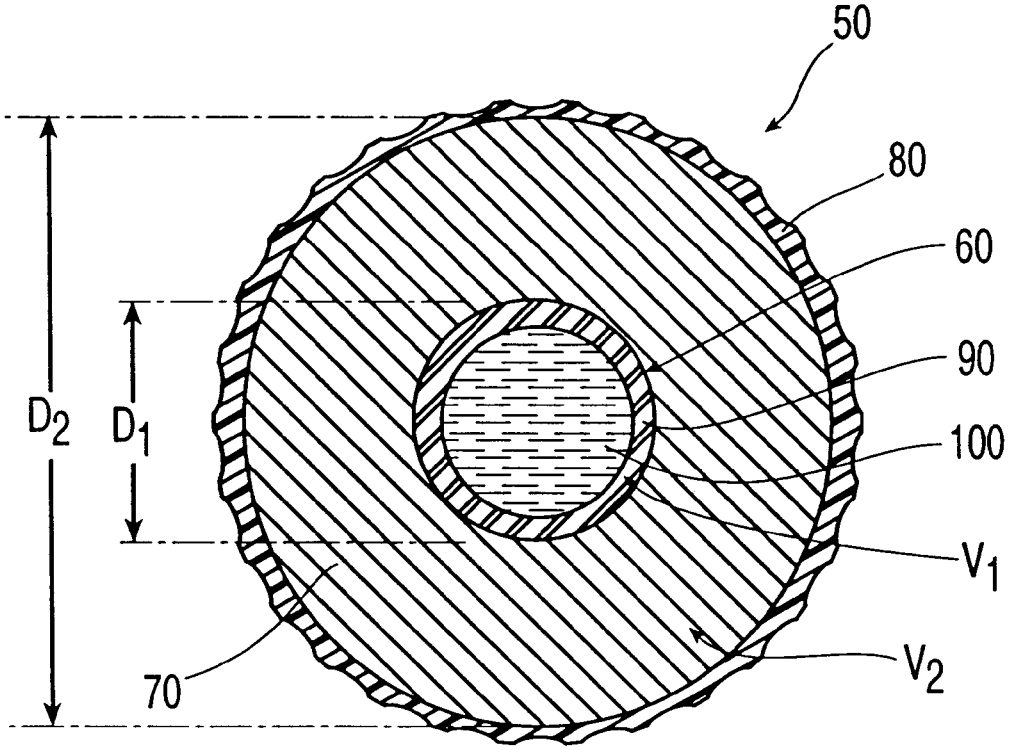
FIG. 5 is a cross-sectional view of the golf ball of FIG. 3 according to another embodiment of the present invention.

As shown in FIGS. 4 and 5, the thread 30 is wound about the center 60 to form the wound layer 70. The windings of the present invention may be wound according to conventional processes and technology. The winding can use the same or various levels of tension and elongation in a conventional fashion. For example, initially the winding can occur at low tension than at a predetermined time or diameter the winding can occur at high tension.

Figure 3:
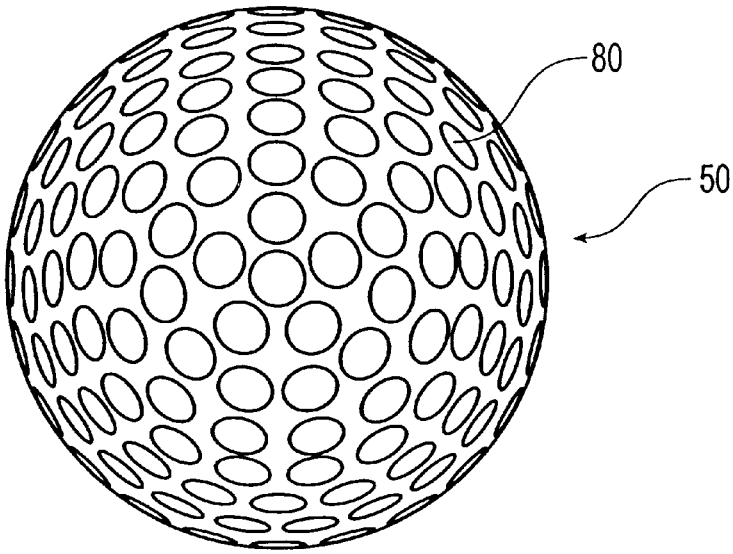
FIG. 3 is an elevational view of a golf ball according to the present invention.

Referring to FIG. 3, the cover 80 provides the interface between the ball 50 and a club. Properties that are desirable for the cover 80 are moldability, high abrasion resistance, high tear strength, high resilience, and good mold release, among others. In accordance with the preferred balls, the cover 80 has a thickness to generally provide sufficient strength, good performance characteristics and durability. Preferably, the cover 80 is of a thickness from about 0.03 inches to about 0.12 inches. More preferably, the cover 80 is about 0.04 to 0.09 inches in thickness and, most preferably, is about 0.05 to 0.085 inches in thickness.

The center 60 of the present invention may be of any dimension or composition. As shown in FIG. 4, the center 60 is solid. The center could be a thermoset solid rubber sphere, a thermoplastic solid sphere, wood, cork, metal, or any material known to one skilled in the art of ball manufacture. Similarly, as shown in FIG. 5, the center 60 could be a liquid-filled sphere or shell 90 such as a rubber sack, a thermoplastic, or metallic shell design. The liquid 100 employed could be of any composition or viscosity. It is also feasible to construct such a center 60 with a void or "gas" center.

Preferably, the center 60 is larger than a typical center because the smaller volume $V_2$ of wound thread 30 around the center 60 enables the center 60 to have a larger volume $V_1$ for a predetermined golf ball diameter. Preferably, the center has an outer diameter $D_1$ of at least about 1.1 inch. Most preferably, the outer diameter $D_1$ of the center is about 1.2 to 1.5 inches. Preferably, the wound layer 70 has an outer diameter $D_2$ of about 1.4 to 1.62 inches. The use of a center 60 with a larger diameter $D_1$ results in improved golf ball characteristics.

The golf balls 50 of FIGS. 4 and 5 may be made by any conventional process employed in the golf ball art. For example, the golf ball 50 of FIG. 4 is manufactured by injection or compression molding the solid center 60. The thread 30 is then wound about the solid center 60 to form the wound layer 70. Different elongations are used depending on the desired results for ball performance. The cover layer or layers 80 is then injection or compression molded or cast about the wound layer 70 which processes are well known in the art.

Turning to FIG. 5, a golf ball 50 of the present invention can be formed by initially forming the shell 90 by compression molding hemispherical cups, the cups are bonded together to form the shell 90 to create and filling the cavity with fluid or liquid 100 to form the center 60. The thread 30 is then wound around the shell 90 to form the wound layer 70. Different elongations are used depending on the desired results for ball performance. The cover 80 is then compression molded or injection molded or cast over the wound layer 70.

A representative base composition for forming a solid golf ball center 60, which is comprised of at least one layer as shown in FIG. 4, comprises polybutadiene and, in parts by weight based on 100 parts polybutadiene, 0–50 parts of a metal salt diacrylate, dimethacrylate, or monomethacrylate, preferably zinc diacrylate. Commercial sources of polybutadiene include Cariflex 1220 manufactured by Shell Chemical, Neocis BR40 manufactured by Enichem Elastomers, and Ubepol BR150 manufactured by Ube Industries, Ltd. If desired, the polybutadiene can also be mixed with other elastomers known in the art, such as natural rubber, styrene butadiene, and/or polyisoprene in order to further modify the properties of the center 60. When a mixture of elastomers is used, the amounts of other constituents in the core composition are based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity. The zinc diacrylate can be of various grades of purity. For the purposes of this invention, the lower the quantity of zinc stearate present in the zinc diacrylate the higher the zinc diacrylate purity. Zinc diacrylate containing less than about 10% zinc stearate is preferable. More preferable is zinc diacrylate containing about 4–8% zinc stearate. Suitable, commercially available zinc diacrylates include those from the Sartomer Corporation. The preferred concentrations of zinc diacrylate that can be used are 0–50 pph and preferably 10–30 pph based upon 100 pph of polybutadiene or alternately, polybutadiene with a mixture of other elastomers that equal 100 pph.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di (t-butylperoxy) 3,3,5-trimethyl cyclohexane, a-a bis (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 pph and 2.5 pph based upon 100 parts of butadiene, or butadiene mixed with one or more other elastomers. More preferably, the amount of initiator added ranges between about 0.15 pph and 2 pph and most preferably between about 0.25 pph and 1.5 pph.

A typical golf ball core incorporates 1 pph to 50 pph of zinc oxide in a zinc diacrylate-peroxide cure system that cross-links polybutadiene during the core molding process.

The compositions of the present invention may also include fillers, added to the elastomeric composition of adjust the density and/or specific gravity of the core. As used herein, the term "fillers" includes any compound or composition that can be used to vary the density and other properties of the subject golf ball core. Fillers used in the golf ball core according to the present invention include, for example, zinc oxide, barium sulfate, and regrind (which is recycled core material ground to about 30 mesh particle size). The amount and type of filler utilized is governed by the amount and weight of other ingredients in the composition, since a maximum golf ball weight of 1.620 ounces (45.92 gm) has been established by the USGA. Appropriate fillers generally used range in specific gravity from about2.0 to 5.6.

Antioxidants may also be included in the elastomer centers produced according to the present invention. Antioxidants are compounds which prevent the breakdown of the elastomer. Antioxidants useful in the present invention include, but are not limited to quinoline type antioxidants, amine type antioxidants, and phenolic type antioxidants.

Other ingredients such as accelerators, e.g., tetra methylthiuram, peptizers, processing aids, processing oils, plasticizers, dyes and pigments, as well as other additives well known to the skilled artisan may also be used in the present invention in amounts sufficient to achieve the purpose for which they are typically used.

A cis-trans conversion catalyst may also be included in the present invention. The catalyst may be an organosulfur or metal-containing organosulfur compound, a substituted or unsubtituted aromatic organic compound that does not contain sulfur or metal, an inorganic sulfide compound, an aromatic organometallic compound, or mixtures thereof. A "cis-to-trans catalyst" herein, means any compound or a combination thereof that will convert at least a portion of cis-polybutadiene isomer to trans-polybutadiene isomer at a given temperature.

As shown in FIG. 5, a center 60 can also be a liquid-filled shell 90. The shell 90 can be filled with a wide variety of materials 100 including air, water solutions, gels, foams, hot-melts, other fluid materials and combinations thereof, as set forth in U.S. Pat. No. 5,683,312 which is incorporated herein by reference.

Examples of suitable liquids include either solutions such as salt in water, corn syrup, salt in water and corn syrup, glycol and water as oils. The liquid can further include pastes, colloidal suspensions, such as clay, barytes, carbon black in water or other liquid, or salt in water/glycol mixtures. Examples of suitable gels include water gelatin gals, hydrogels, water/methyl cellulose gels and gels comprised of copolymer rubber based materials such as a styrene-butadiene-styrene rubber and paraffinic and/or naphthenic oil. Examples of suitable melts include waxes and hot melts. Hot-melts are materials which at or about normal room temperatures are solid but at elevated temperatures become liquid. A high melting temperature is desirable since the liquid core is heated to high temperatures during the molding of the cover.

The liquid 100 within the shell 90 can be a reactive liquid system which combine to form a solid. Examples of suitable reactive liquids are silicate gels, agar gels, peroxide cured polyester resins, two part epoxy resin systems and peroxide cured liquid polybutadiene rubber compositions. It is understood by one skilled in the art that other reactive liquid systems can likewise be utilized depending on the physical properties of the shell and the physical properties desired in the resulting finished golf balls.

Figure 6:
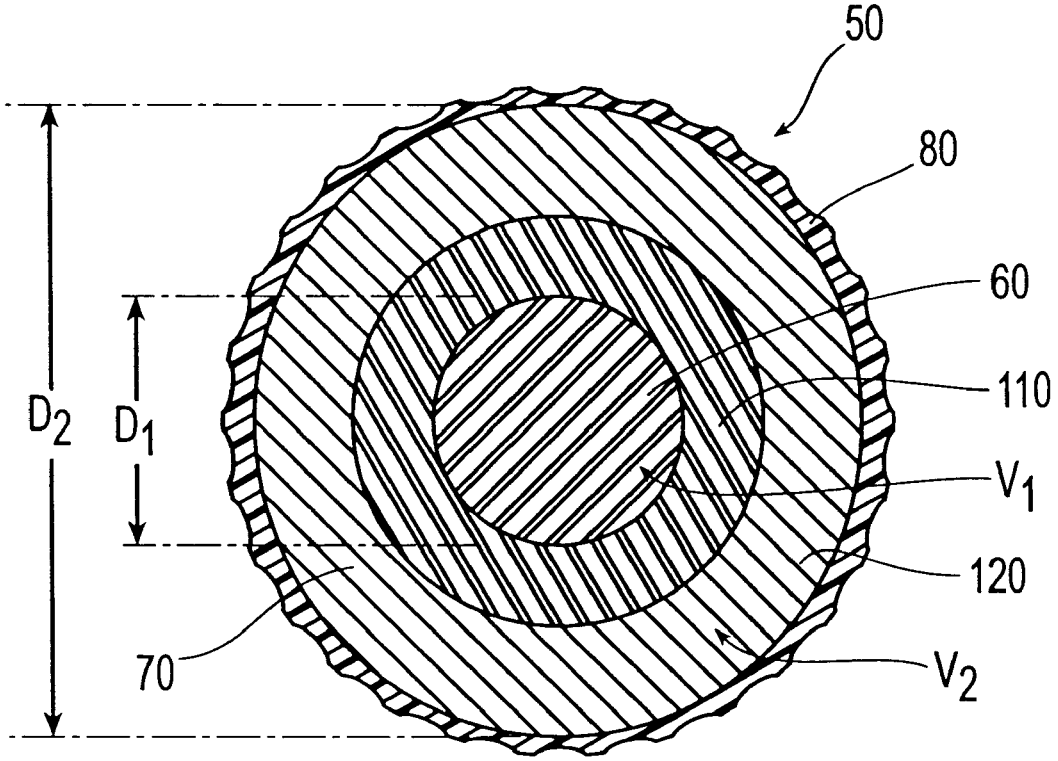
FIG. 6 is a cross-sectional view of another embodiment of a golf ball according to the present invention.

As shown in FIG. 6, the golf ball 50, in yet another embodiment, is comprised of a center 60, a cover 80 and a wound component 70 therebetween. The wound component is comprised of a first wound 110 and a second wound layer 120, wherein the first wound layer has first threads according to the present invention and the second layer 120 has threads having different physical properties than the first threads. The first threads are comprised of about 10 or more individual fibers or strands. Preferably, the thread contains more than 50 strands. The strands are continuous filaments with diameters typically of less than 0.01 inches. Preferably, the strand diameter is less than about 0.002 inches. In a first embodiment, the second threads are either single-ply or two-ply threads as is well known in the art. Most preferably, the second thread is a two-ply thread made by mixing synthetic cis-polyisoprene rubbers, natural rubber and a curing system together, calendering this mixture into two sheets, curing the sheets, and slitting the sheets into threads having a generally rectangular or square cross-section. In a second embodiment, the second threads 120 are also comprised of threads according to the present invention, but have different physical properties than the first strands. The thread component may have a second thread having an elastic modulus in the wound state of less than or greater than 20 ksi. Preferably, the second strands have an elastic modulus at winding that is at least 10% different from the elastic modulus of the first thread.

The cover 80 of the golf ball 50 can be comprised of one or more layers and is generally made of polymeric materials such as ionic copolymers of ethylene and an unsaturated monocarboxylic acid which are available under the trademark "SURLYN" of E.I. DuPont de Nemours & Company of Wilmington, Del. or "IOTEK" or "ESCOR" from Exxon. These are copolymers of terpolymers of ethylene and methacrylic acid or acrylic acid partially neutralized with zinc, sodium, lithium, magnesium, potassium, calcium, manganese, nickel or the like.

In another embodiment, the cover 80 can be formed from mixtures or blends of zinc, lithium and/or sodium ionic copolymers or terpolymers.

Also, Surlyn® resins for use in the cover 80 are ionic copolymers or terpolymers in which sodium, lithium or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The invention can likewise be used in conjunction with covers 80 having homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes such as those prepared from polyols and diisocyanates or polyisocyanates and those disclosed in U.S. Pat. No. 5,334,673.

(4) Polyureas such as those disclosed in U.S. Pat. No. 5,484,870.

(5) Polyamides such as poly(hexamethylene adipamide) and others prepared from diamines and dibasic acids, as well as those from amino acids such as poly (caprolactam), and blends of polyamides with Surlyn, polyethylene, ethylene copolymers, ethyl-propylene-non-conjugated diene terpolymer, etc.

(6) Acrylic resins and blends of these resins with poly vinyl chloride, elastomers, etc.

(7) Thermoplastics such as the urethanes, olefinic thermoplastic rubbers such as blends of polyolefins with ethylene-propylene-non-conjugated diene terpolymer, block copolymers of styrene and butadiene, isoprene or ethylene-butylene rubber, or copoly(ether-amide), such as PEBAX sold by ELF Atochem.

(8) Polyphenylene oxide resins, or blends of polyphenylene oxide with high impact polystyrene as sold under the trademark "Noryl" by General Electric Company, Pittsfield, Mass.

(9) Thermoplastic polyesters, such as polyethylene terephthalate, polybutylene terephthalate, polyethylene terephthalate/glycol modified and elastomers sold under the trademarks "Hytrel" by E.I. DuPont de Nemours & Company of Wilmington, Del. and "Lomod" by General Electric Company, Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. and polyvinyl chloride with acrylonitrile butadiene styrene or ethylene vinyl acetate or other elastomers. Blends of thermoplastic rubbers with polyethylene, propylene, polyacetal, nylon, polyesters, cellulose esters, etc.

Preferably, the cover 80 is comprised of polymers such as ethyelene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenyl sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof. Still further, the cover 80 is preferably comprised of a polyether or polyester thermoplastic urethane, a thermoset polyurethane, an ionomer such as acid-containing ethylene copolymer ionomers, including E/X/Y terpolymers where E is ethylene, X is an acrylate or methacrylate-based softening comonomer present in 0 to 50 weight percent and Y is acrylic or methacrylic acid present in 5 to 35 weight percent. More preferably, in a low spin rate embodiment designed for maximum distance, the acrylic or methacrylic acid is present in 15 to 35 weight percent, making the ionomer a high modulus ionomer. In a high spin embodiment, the cover includes an ionomer where an acid is present in 10 to 15 weight percent and includes a softening comonomer.

These and other aspects of the present invention may be more fully understood with reference to the following non-limiting examples, where are merely illustrative of the preferred embodiment of the present invention golf ball construction, and are not to be construed as limiting the invention, the scope of which is defined by the appended claims.

EXAMPLE 1

A golf ball according to the present invention had a solid center, a wound layer surrounding the solid center, and a cover surrounding the wound layer.

The center was comprised of a solid polybutadiene composition and had a diameter of about 1.39 inches. The center was wound with a thread, LYCRA, comprised of polymerization spun polyether urea. The thread comprised about 125 strands with diameters of about 0.001 inch. The area of the thread was about 0.00017 inches squared. The center diameter was 1.39 inches, and the center and the windings had an outer diameter of about 1.56 inches. The thread was wound about the center at elongations to about 300%. The windings were then covered by a compression molded SURLYN cover.

The following chart compares the center composition of the ball made according to Example 1 of the present invention with the center composition of a comparative ball.

Center Composition

| Constituent | Example 1 Parts | Comparative Parts |
|---|---|---|
| Polybutadiene | 100 | 90.22 |
| Polyisoprene | | 9.78 |

-continued

Center Composition

| Constituent | Example 1 Parts | Comparative Parts |
|---|---|---|
| Zinc Diacrylate | 24 | |
| Zinc Oxide | | 5.00 |
| Dicumyl Peroxide | | 1.60 |
| Di(2-t-butyl-peroxyisopropyl)benzene | 0.096 | |
| Calcium Oxide | 2.16 | |
| Barium Sulfate | 43.68 | 132.87 |
| 1,1-bis(t-butylperoxy)-3,3,5-trimethylcyclohexane | 0.172 | 9.78 |
| 2,2'-methylene bis 4 methyl-6-tert-butylphenol | | 0.74 |
| Struktol WB 212* | | 11.10 |
| Calcium Carbonate | | 46.76 |
| Trimethylolpropane Trimethacrylate | | 9.78 |

*Struktol WB212 is a processing aid available from Struktol Corp.

The following chart compares the cover composition of the ball made according to Example 1 with the cover composition of the comparative ball.

Cover Composition

| Constituent | Example 1 Parts | Comparative Parts |
|---|---|---|
| SURLYN 8140 | 20 | 20 |
| SURLYN 7940 | 30 | 30 |
| SURLYN 7930 | 50 | 50 |

The following chart compares the various statistics and testing results of the ball made according to Example 1 and a comparative ball.

| Ball | Center Diameter (in) | Core Diameter* (in) | Compression** | Velocity (ft/s) | Driver Spin (rpm) |
|---|---|---|---|---|---|
| Example 1 | 1.39 | 1.565 | 72 | 252.1 | 3446 |
| Comparative | 1.065 | 1.565 | 94 | 252.5 | 4328 |

*Core diameter is the diameter of the center and windings.
**Compression was measured on an ATTI compression gage and has been referred to as PGA compression.

As is evident from the above chart, the golf ball according to Example 1 has a substantially larger center diameter than the comparative ball; however, the core diameters and cover of the two balls are identical. The Example ball includes windings according to the present invention, while the comparative ball is made with conventional polyisoprene thread. Even so, the compression of the golf ball made according to Example 1 is much lower than the compression of the comparative ball. Thus, the ball according to Example 1 is significantly softer for the user. Further, while the velocity of the golf ball according to Example 1 has dropped slightly in comparison with the comparative ball, the spin of the ball according to Example 1 has been greatly reduced in comparison to the comparative ball. Thus, the ball according to Example 1 results in a golf ball with a lower compression and spin rate which will result in longer distance.

EXAMPLE 2

A golf ball according to the present invention had a liquid center enclosed by a shell, a wound layer surrounding the liquid center, and a cover surrounding the wound layer.

The liquid center was a salt, water and corn syrup solution comprised of 40% salt, 30% water and 30% corn syrup. The liquid was surrounded by a polypropylene shell. The liquid center had a outer diameter of about 1.3 inches. The center was wound with a thread, LYCRA, comprising solvent spun polyether urea. The thread was comprised of about 125 strands with diameters of about 0.0001 inch. The outer diameter of the center and the windings was about 1.58 inches. The thread was wound at elongations to about 300%. The windings were then covered by a molded ionomer cover.

EXAMPLE 3

A golf ball according to the present invention had a solid center, a wound layer surrounding the solid center, and a cover surrounding the wound layer.

The solid center was comprised of a polybutadiene composition. The center had a outer diameter of about 1.4 inches. The center was wound with a thread comprising melt spun polyethylene SPECTRA. The thread was comprised of about 100 strands with diameters of about 0.0001 inch. The outer diameter of the center and the windings was about 1.58 inches. The thread was wound at elongations to about 2%. The windings were then covered by a molded polyurethane cover.

While it is apparent that the illustrative embodiments of the invention herein disclosed fulfills the objectives stated above, it will be appreciated that numerous modifications and other embodiments may be devised by those skilled in the art. For example, the smaller diameter thread used with the present invention could have strands of varying diameters. Therefore, it will be understood that the appended claims are intended to cover all such modifications and embodiments which come within the spirit and scope of the present invention.

We claim:

1. A golf ball comprising:

a center having a diameter of at least 1.1 inch; and a polymer or glass thread wound about the center, and the thread comprised of greater than 10 individual strands;

wherein the thread is wound at elongations of at least 100%.

2. A golf ball comprising:

a center having a diameter of at least 1.1 inch; and a polymer or glass thread wound about the center, and the thread comprised of greater than 10 individual strands;

wherein at least one strand has a diameter of less than 0.01 inch.

3. The golf ball of claim 2 wherein the thread is melt, wet, dry or polymerization spun.

4. The golf ball of claim 3 wherein the thread is polymeric.

5. The golf ball of claim 4 wherein the thread is a polyether urea.

6. The golf ball of claim 2 wherein the thread is wound at elongations of at least 200%.

7. The golf ball of claim 1 wherein the thread has an elastic modulus in the wound state of between 20 ksi and 50,000 ksi.

8. The golf ball of claim 2 wherein the diameter of the center is between 1.2 and 1.5 inch.

9. The golf ball of claim 8 wherein the center is solid.

10. The golf ball of claim 8 wherein the center is fluid-filled.

11. The golf ball of claim 2 wherein the maximum elongation of the thread is greater than 8%.

12. A golf ball comprising:

a center having a diameter of at least 1.1 inch;

a cover; and a wound thread disposed between the center and the cover, the wound thread comprising at least 25 strands having areas of less than 0.0001 inches squared and wound at elongations of at least 200%, and the wound thread having a wound modulus greater than 20,000 psi.

13. The golf ball of claim 12 wherein the thread is polymerization spun polyether urea.

14. The golf ball of claim 12 wherein the strands have areas of less than 0.00001 inches squared.

15. The golf ball of claim 12 wherein the thread has an area of less than 0.001 inches squared.

16. A golf ball comprising:

a center having a diameter of at least 1.1 inch;

a cover; and a wound component disposed between the center and the cover, the wound component comprised of at least one layer of a first thread comprising at least 25 strands having areas of less than 0.0001 inches squared and the first thread having a wound modulus greater than 20,000 psi.

17. The golf ball of claim 16 wherein at least one strand has a diameter of less than 0.01 inch.

18. The golf ball of claim 16 wherein the first thread is melt, wet, dry or polymerization spun.

19. The golf ball of claim 18 wherein the first thread is polymeric.

20. The golf ball of claim 19 wherein the first thread is a polyether urea.

21. The golf ball of claim 16 wherein the first thread is wound at elongations of at least 200%.

22. The golf ball of claim 16 wherein the thread component has a second thread having an elastic modulus in the wound state of less than 20 ksi.

23. The golf ball of claim 16 wherein the thread component has a second thread having an elastic modulus in the wound state of greater than 20 ksi.

24. The golf ball of claim 16 wherein the wound component has an outer diameter of between 1.4 and 1.62 inch.

25. The golf ball of claim 16 wherein the center is solid.

26. The golf ball of claim 16 wherein the center is fluid-filled.

27. The golf ball of claim 16 wherein the maximum elongation of the first thread is greater than 8%.

* * * * *